US005949517A

United States Patent [19]

Lindberg et al.

[11] Patent Number: 5,949,517

[45] Date of Patent: Sep. 7, 1999

[54] CASE FOR A CLIP-ON SPECTACLE SHIELD

[75] Inventors: Poul-Jørn Lindberg, Egå; Henrik Lindberg, Århus, both of Denmark

[73] Assignee: Lindberg A/S, Abyhoj, Denmark

[21] Appl. No.: 09/181,684

[22] Filed: Oct. 28, 1998

Related U.S. Application Data

[63] Continuation-in-part of application No. PCT/DK97/00198, May 1, 1997, abandoned.

[30] Foreign Application Priority Data

May 2, 1996 [DK] Denmark ..... 0528/96

[51] Int. Cl.[6] ..... G02C 1/00

[52] U.S. Cl. ..... 351/158; 351/47; 206/5

[58] Field of Search ..... 351/44, 47, 158; 206/5

[56] References Cited

U.S. PATENT DOCUMENTS 3,559,798 2/1971 Jacobsen .
3,819,033 6/1974 Hueber .
4,000,810 1/1977 Leblanc .
4,863,013 9/1989 Eastman .
5,642,177 6/1997 Nishioka ..... 351/47

*Primary Examiner*—Huy Mai
*Attorney, Agent, or Firm*—Thomas R. Vigil

[57] ABSTRACT

The present invention relates to a case (30) for a clip-on spectacle shield comprising a retainer guide (31) and two housings (35) arranged for receiving respective shield lenses of the clip-on shield where the connecting bridge of the clip-on shield extends from one housing to the other, said case being characterised in that the retainer guide is made of a dimensionally stable material, that the retainer guide is made to secure the housings and to support the connecting bridge of the clip-on shield in a well-defined orientation, that the housings are made of a resilient material and are configured to tightly enclose the shield lenses so as to ensure that the case is deformed elastically for an increased curvature when the clip-on shield is contained therein whereby the clip-on shield is secured elastically.

16 Claims, 3 Drawing Sheets

CASE FOR A CLIP-ON SPECTACLE SHIELD

CROSS REFERENCE TO RELATED APPLICATIONS

This is a continuation-in-part of International Application PCT/DK97/00198, with an international filing date of May 1, 1997, now abandoned. This application is based on application Ser. No. 0528/96 filed in Denmark on May 2, 1996, the contents of which are incorporated hereinto by reference.

BACKGROUND OF THE INVENTION

1. Field of the invention

The present invention relates to a case for a clip-on spectacle shield and in particular a case intended for containing the clip-on shield in order to prevent the clip-on shield from being scratched, etc. In general the case is intended for removable shields for spectacles that are typically used with tinted lenses to reduce incident sun light when desired. A clip-on shield of this type is described e.g. in international patent application No. PCT/DK96/00040 published on Oct. 24, 1996, a counterpart of U.S. patent application Ser. No. 08/947,623, still pending, the contents of which are incorporated hereinto by reference.

2. The Prior Art

Soft cases are available on the market that are, in principle, in the form of a flattened tube closed at the one end and open at the other. Usually such cases do not secure the clip-on shield. Moreover shaped cases are available made of a comparatively rigid material with hinged covers or optionally in the form of two hingedly connected halves that may be opened or closed.

SUMMARY OF THE INVENTION

The invention, in a first aspect, provides a case adapted for the entering and the holding of a clip-on spectacle shield, which spectacle shield comprises a pair of shield lenses and a connecting bridge, said case comprising a structural member and a pair of sleeve members arranged for receiving respective shield lenses in an a configuration where the connecting bridge of the clip-on shield straddles from one sleeve member to the other, wherein said structural member comprises a substantially rigid body, which body secures the sleeve members in a spaced relationship, and which body comprises means for the abutment of the connecting bridge, wherein said sleeve members comprise resilient means, wherein said sleeve members are adapted to enclose the shield lenses in a tight fit in order that at least part of the sleeve members are strained resiliently and at least part of the sleeve members curved on entering the clip-on shield into the case, the resilient means providing a reaction force, which provides a hold on the clip-on shield.

Hereby a case is provided which may be kept in very confined spaces and which is not damaged if subjected to pressure during storage, that provides adequate protection of the shield and retains the clip-on shield once it is contained therein, while simultaneously allowing very easy discharge of the clip-on shield.

The case is soft and elastic and if used in connection with a clip-on shield which is also soft and elastically deformable it is obtained that the case enclosing the clip-on shield may tolerate considerable deformation without the clip-on shield being forced out of position and without any of its constituents being damaged. This is very convenient since the combined product may tolerate storage e.g. at the bottom of a handbag where it is subjected to pushing and squeezing in an irregular manner, without sustaining any damage and without the combined case and clip-on shield presenting any hard or sharp edges themselves which may cause damage to other objects, accidentally contacted.

The invention, in a second aspect, provides a combination of a clip-on spectacle shield and a case, wherein said spectacle shield comprises a pair of shield lenses and a resilient connecting bridge, wherein said case is adapted for the entering and the holding of said clip-on spectacle shield, wherein said case comprises a structural member and a pair of pliable sleeve members adapted for receiving respective shield lenses in a configuration where the connecting bridge of the clip-on shield straddles from one sleeve member to the other, wherein said structural member comprises a substantially rigid body, which body secures the sleeve members in a spaced relationship, and which body comprises means for the abutment of the connecting bridge, wherein said sleeve members are adapted to enclose the shield lenses in a tight fit, whereby at least part of said connecting bridge is strained resiliently on entering said clip-on shield into said case, said resilient connecting bridge providing a reaction force, which provides a hold on the clip-on shield.

This combination provides convenient storage and protection of a clip-on shield by which the clip-on shield is readily available for removal from the case any time. Due to flexible members of the case in combination with resilient parts of the clip-on shield, a combination is obtained which is soft and elastically deformable, suited for sustaining considerable deformation without any danger of the clip-on shield being accidentally losened from its position and without any danger of parts of the combination being accidentally damaged. Thus the combination is well suited for casual or rugged treatment, such as being stored and carried in a handbag among other belongings with no special precautions taken. Also the combination avoids rigid elements which might cause damage to other objects accidentally contacted by the combination.

The sleeve members provide protection for the shield lenses, thereby avoiding undesirable damage of the shields, such as scratching of the surfaces. The feature of the shield connecting bridge straddling from one sleeve member to the other one ensures that the connecting bridge is presented in a well-defined position for ready access for the purpose of removing the shield lenses from the case at any time.

Convenient embodiments of the invention will appear from the dependent claims.

Further characteristic features and advantages of the invention will be described in further detail in the following detailed description given with reference to the drawings.

DESCRIPTION OF THE PREFERRED EMBODIMENTS

Figure 1:
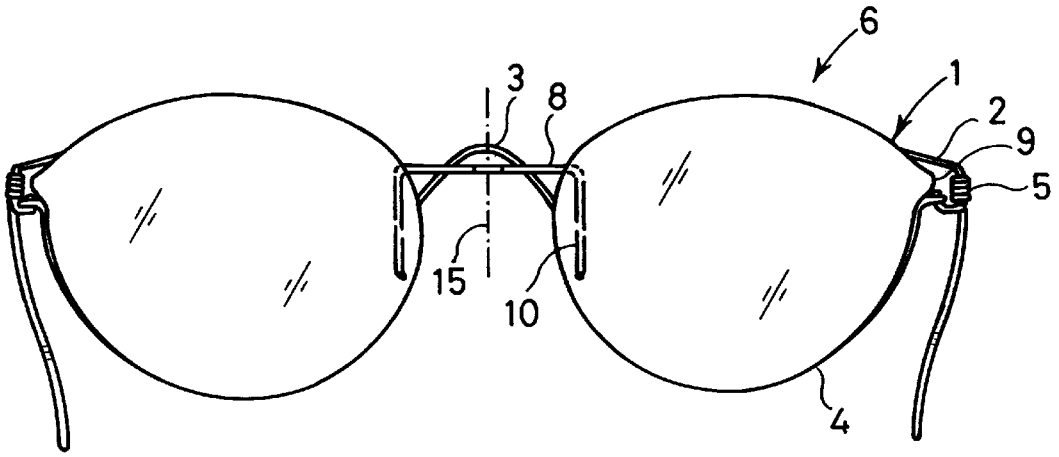
FIG. 1 is a front view of a pair of spectacles with fitted clip-on shield to illustrate a preferred use of the invention.

All figures are schematical and not necessarily to scale and illustrate only details essential to the understanding of the invention while other details have been omitted. In all figures the same reference numerals are used for identical or corresponding details.

Reference is first made to FIG. 1 that illustrates a pair of spectacles 1 comprising a frame 2 holding two lenses 4. In a usual manner the frame comprises a connecting bridge or a nose bridge 3 and hinges 5 for the temple bars. The pair of spectacles is symmetrical about a plane of symmetry indicated by the dash-dotted line 15. The pair of spectacles is shown exclusively to illustrate how the clip-on shield is attached and it is not a part of this invention.

The clip-on shield for spectacles as a unit is designated by the reference numeral 6 and it comprises two shield lenses 7 and a connecting bridge or nose bridge 8 that secures the shield lenses relative to each other. Preferably the clip-on shield is symmetrical about an axis of symmetry which, in the intended position, coincides with the plane of symmetry 15 of the spectacles. The shield lenses may be made of glass or —more commonly—a plastics material which has been coloured or coated to provide the desired optical properties. At their laterally outermost rim parts, the shield lenses 7 are provided with guide pins arranged opposite the hinges 5 for the temple bars.

The connecting bridge of the clip-on shield consists of a piece of wire 11 which, as depicted in FIG. 1, extends horizontally from one lens to the other and being at its extremities angled substantially vertically downwards, the downwardly extending sections forming spacer elements 10.

Figure 2:
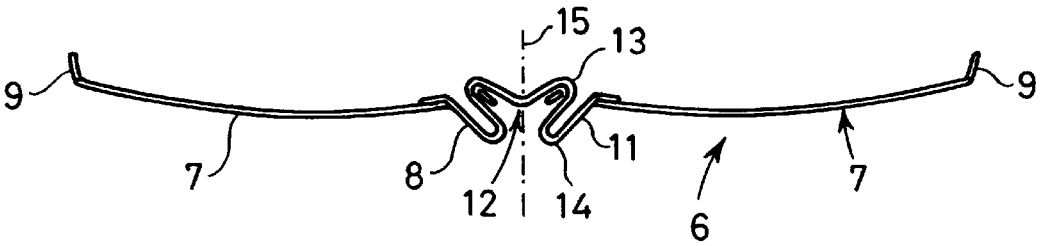
FIG. 2 is a horizontal sectional view through the clip-on shield shown in FIG. 1.

FIG. 2 is a sectional plan view of the clip-on shield and it will appear that the shield lenses 7 extend arcuately and how the wire 11 that forms the connecting bridge follows a wavy course wherein the central portion forms an angle whose apex is forwardly oriented, i.e. downwardly oriented in FIG. 2. This apex constitutes the engagement tongue 12 of the clip-on shield. At a further distance from the plane of symmetry 15, the wire 11 passes through a substantially U-shaped bend wherein the concave portion of the U inclines forwards and towards the centre. This bending will be designated the straddle 13 in the following, since it serves the purpose of defining an area which may straddle the connecting bridge 3 of the spectacles as indicated by the dotted line in FIG. 2.

The wire continues by inclining forwardly in an oppositely oriented U-shaped bend from where it continues by inclining backwards and outwards. This bend, the convex part of which faces forwards and into the plane of symmetry, is designated the finger bend 14, as it serves the purpose of providing a support for the fingers when the clip-on shield is to be fitted or taken off, or the spectacles are to be pushed upwards. From the finger bend 14 the wire continues to a point beyond the respective shield lens 7 slightly within its rim. Here, as mentioned above, the wire is angularly bent whereby the extremity becomes downwardly oriented. The wire is secured to the shield lens 7 by its vertical section that constitutes a spacer element 10 defining the minimum distance of the shield lens relative to the lens of the spectacles at this point.

The wire may be secured to the shield lens by any of the known methods without departing from the scope of the invention. According to one embodiment a hollow sleeve is glued to the back of the lens and the wire is taken through the sleeve and secured e.g. by folding of a protruding extremity. According to a second embodiment a hollow sleeve is secured to the shield lens with pins or protrusions that are taken through recesses in the shield lens. According to a third embodiment the wire is folded and taken through suitable bores in the shield lens, optionally back and forth. Other arrangements and attachments may also be suitable.

A friction surface may be realised by manufacturing the sleeve from a friction material or by providing sections of the wire with a frictional coating or by providing portions of the shield lens with a frictional coating.

As will appear from studying FIGS. 2 and 1, the spacer element is located fairly closely to the innermost rim of the respective shield lens while the remainder of the lens surface has no spacer elements which means that it is possible to establish contact in points or in sections between shield lenses and frame or lenses.

According to a preferred embodiment the wire comprises a resilient material which may be folded to the shape described. Suitable materials include alloys of titanium, aluminium, gold, etc. Other suitable materials may be suggested by a person skilled in the art.

Figure 3:
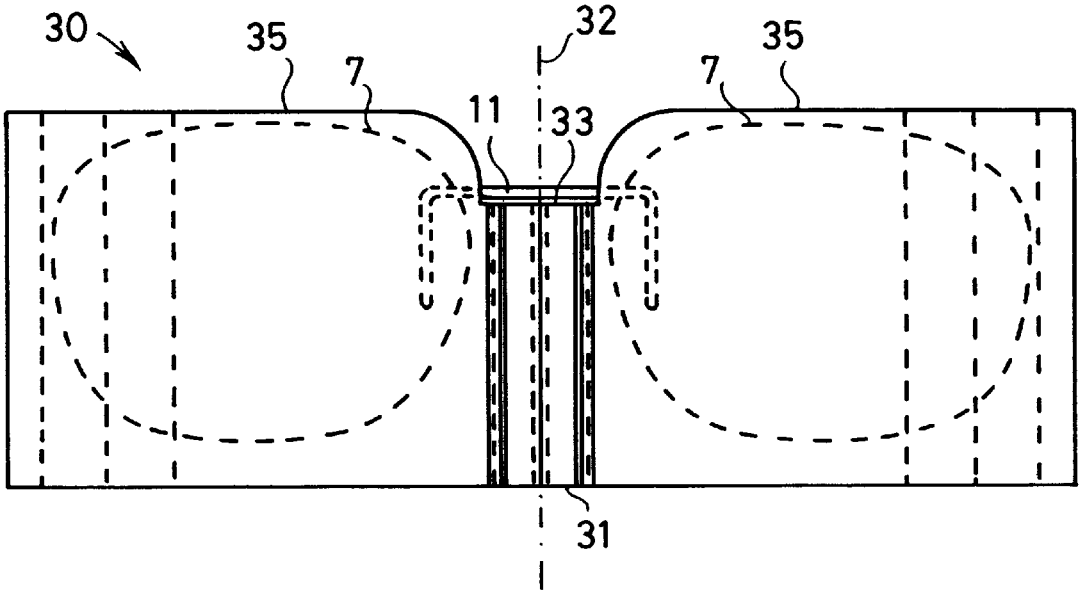
FIG. 3 is a front view of the case according to the invention containing a clip-on shield in the storage position thereof.

FIG. 3 is a front view of the case according to the invention with a fitted clip-on shield, said shield being outlined with dotted lines as regards the components that are invisible from the outside of the case. FIG. 3 illustrates how the case 30 comprises a retainer guide 31 which is symmetrical about the plane of symmetry 32 and two identical compartments or housings 35 located at either side of the retainer guide 31 whereby a unit is provided which is inverted symmetrically about the plane of symmetry 32.

Figure 4:
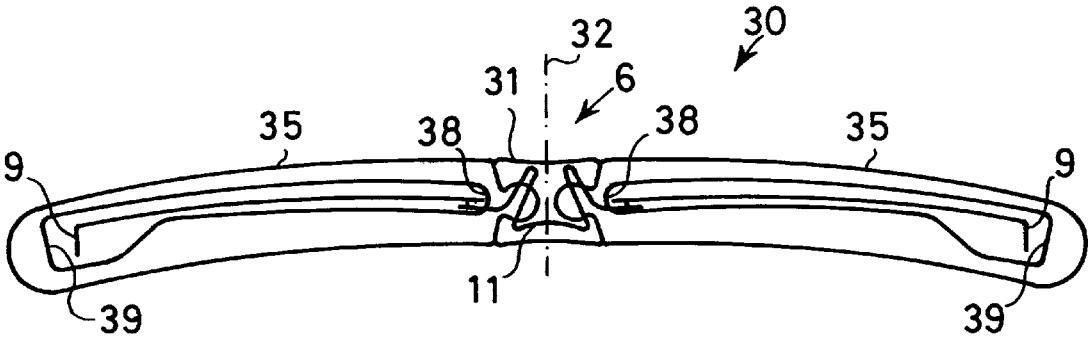
FIG. 4 is a top plan view of the illustration shown in FIG. 3.
Figure 7:
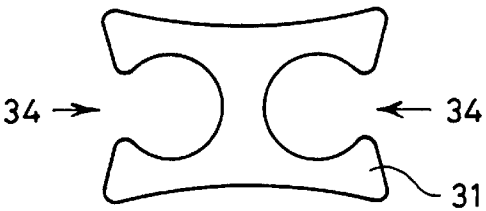
FIG. 7 illustrates a retainer guide which is a further constituent of the case according to the invention.
Figure 8:
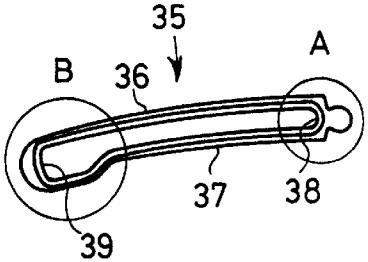
FIG. 8 is a top plan view of the housing shown in FIG. 6.
Figure 10:
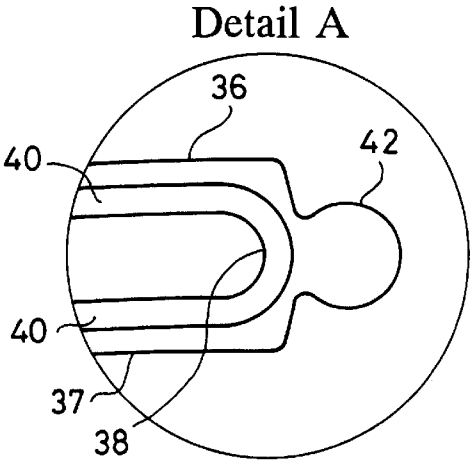
FIG. 10 illustrates the detail A from FIG. 8 in an enlarged scale.

Reference now being made to FIGS. 4 and 7, it will appear how the retainer guide comprises grooves 34 at either side while the housings 35 comprises corresponding beads 42, as will appear from FIGS. 4, 8 and 10, which beads are shaped to match the grooves 34 to provide attachment of the housings.

Figure 6:
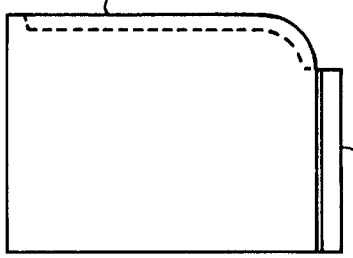
FIG. 6 is a front view of the housing shown in FIG. 5.
Figure 5:
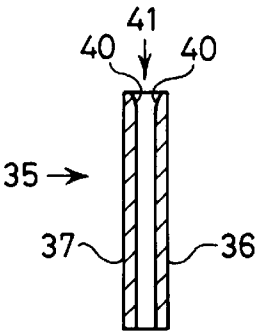
FIG. 5 is a vertical sectional view through a housing which is a constituent of the case according to the invention.

The left housing is illustrated in FIG. 6, and it is seen in a vertical sectional view in FIG. 5, and study thereof will reveal that the housing is open upwardly and downwardly, the upwardly facing edges having bevels 40 that form a funnel-like entry opening 41.

Figure 9:
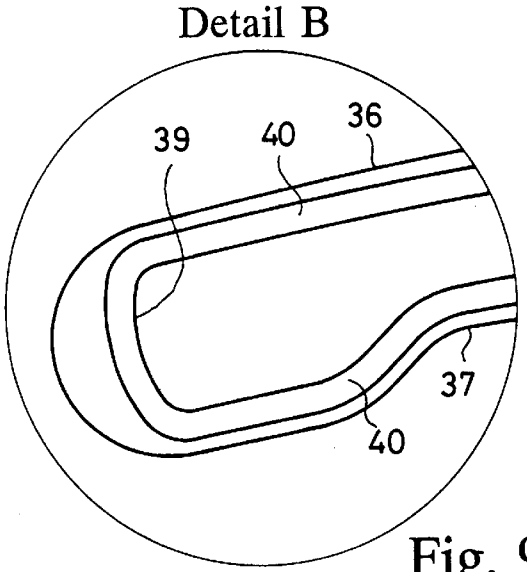
FIG. 9 illustrates the detail B from FIG. 8 in an enlarged scale.

Reference now being made to FIGS. 8, 9 and 10, it will appear that the case 35 forms a cavity delimited by the front 36, the back 37, the inner housing fillet 38, and the outer housing fillet 39. The designations front and back refer to the intended fitting position of the clip-on shield, viz. with its lens front facing towards the front. The term 'inner housing fillet' is used to describe that the internal rim of the shield lens faces towards the rounded inner fillet whereas the outer rim faces towards the rounded outer fillet. The width of the cavity to the shield lens is increased in the vicinity of the outer fillet whereby only a clip-on shield with backwardly oriented pins 9 can be received at the outer rims, as will appear from FIG. 4.

As will appear from FIG. 3, in principle the case consists of two separate cavities that each receives the respective shield lenses of the clip-on shield. The retainer guide 31 has a planar top surface 33 which is perpendicular to the plane of symmetry 32. This top surface constitutes a solid abutment for a correspondingly configured connecting bridge 11 in the clip-on shield. When the clip-on shield is fitted in firm abutment with the planar top surface 33, the location of the clip-on shield is consequently controlled by the abutment on the top surface 33 and by the lens inner rims supporting on the inner fillet 38.

The retainer guide 31 is made of a dimensionally stable material, preferably a profile which may be extruded of aluminium or mould cast in aluminium or a plastics material. The thickness of the retainer guide may be e.g. 9 mm.

Preferably the housings 35 are made of a soft material, such as rubber with a Shore-A hardness of 60. The wall thickness of the front and the rear may be 2–2.5 mm.

According to the invention the housings are so configured that in its empty state the case extends substantially rectilinearly or describes a very flattened arch, while the case must be curved into increased curvature in order to conform the clip-on shield, once introduced. The radii of curvature in its empty state may be e.g. 200 and 220 mm, respectively, for the back and the front, respectively, while the radius of curvature of the clip-on shield is about 150 mm, both in their relaxed state. The resilience of the housings and the friction on the insides serve to ensure adequate retention of the clip-on shield. Hereby advantage is taken of the resilience of the clip-on shield and in particular of the connecting bridge 11 of the clip-on shield.

According to one embodiment the housings and in particular their inner fillets are adapted to ensure that the inner rims of the shield lenses have a certain abutment pressure in a direction towards the plane of symmetry 32. Hereby advantage is taken of the resilience of the clip-on shield's connecting wire to ensure retention. The case containing the clip-on shield may tolerate a very high degree of deformation without this engagement tending to loosen.

In its storage position the clip-on shield is so arranged, as shown in FIG. 3, that the shield lenses are completely protected by the housings whereas the connecting bridge is shielded, but yet readily accessible whereby it is easy to seize the clip-on shield to remove it from the case. Handling is particularly convenient in case of a clip-on shield which may be fitted onto a pair of spectacles by seizure of the connecting bridge between two of one's fingers as is the case with the clip-on shield featured in the above identified patent application Ser. No. 08/947,623.

Although specific embodiments will have become apparent from the above disclosure, it will be understood that they have been described exclusively to exemplify the invention and not to limit same, and that the invention may be widely modified by the person skilled in the art without departing from the scope defined by the appended claims.

We claim:

1. A case adapted for the entering and the holding of a clip-on spectacle shield, which spectacle shield comprises a pair of shield lenses and a connecting bridge, said case comprising a structural member and a pair of sleeve members arranged for receiving respective shield lenses in a configuration where the connecting bridge of the clip-on shield straddles from one sleeve member to the other, wherein said structural member comprises a substantially rigid body, which body secures the sleeve members in a spaced relationship, and which body comprises means for the abutment of the connecting bridge, wherein said sleeve members comprise resilient means, wherein said sleeve members are adapted to enclose the shield lenses in a tight fit in order that at least part of the sleeve members are strained resiliently and at least part of the sleeve members curved on entering the clip-on shield into the case, the resilient means providing a reaction force, which provides a hold on the clip-on shield.

2. The case according to claim 1, wherein the hold on the clip-on shield is secured by friction between the clip-on shield and the insides of respective sleeve members.

3. The case according to claim 1, wherein each of said sleeve members comprises an edge defining an opening for entering the clip-on case, wherein said edge is inwardly beveled in order to guide the clip-on shield during the stage of entering.

4. The case according to claim 1, wherein each of said sleeve members are formed as a respective hose with openings in opposing ends.

5. The case according to claim 1, wherein said structural member comprises an elongate profile member made of polymer or of aluminum.

6. The case according to claim 5, wherein said elongate member comprises a pair of grooves on opposing sides, wherein each of said sleeve members comprises an elongate bead, each of said grooves comprising a reduced opening adapted for mating engagement with a respective bead.

7. The case according to claim 1, wherein said sleeve members comprise a soft, flexible material including rubber.

8. The case according to claim 7, wherein said sleeves comprise rubber with a Shore-A hardness of about 60 and with a wall thickness in the range of 2 to 2.5 mm.

9. A combination of a clip-on spectacle shield and a case, wherein said spectacle shield comprises a pair of shield lenses and a resilient connecting bridge, wherein said case is adapted for the entering and the holding of said clip-on spectacle shield, wherein said case comprises a structural member and a pair of pliable sleeve members adapted for receiving respective shield lenses in a configuration where the connecting bridge of the clip-on shield straddles from one sleeve member to the other, wherein said structural member comprises a substantially rigid body, which body secures the sleeve members in a spaced relationship, and which body comprises means for the abutment of the connecting bridge, wherein said sleeve members are adapted to enclose the shield lenses in a tight fit, whereby at least part of said connecting bridge is strained resiliently on entering said clip-on shield into said case, said resilient connecting bridge providing a reaction force, which provides a hold on the clip-on shield.

10. The combination according to claim 9, wherein the hold on said clip-on shield is secured by friction between said clip-on shield and the insides of respective sleeve members.

11. The combination according to claim 9, wherein each of said sleeve members comprises an edge defining an opening for entering said clip-on case, wherein said edge is inwardly beveled in order to guide said clip-on shield during the stage of entering.

12. The combination according to claim 9, wherein each of said sleeve members are formed as a respective hose with openings in opposing ends.

13. The combination according to claim 9, wherein said structural member comprises an elongate profile member made of polymer or of aluminum.

14. The combination according to claim 13, wherein said elongate member comprises a pair of grooves on opposing sides, wherein each of said sleeve members comprises an elongate bead, each of said grooves comprising a reduced opening adapted for mating engagement with a respective bead.

15. The combination according to claim 9, wherein said sleeve members comprise a soft, flexible material including rubber.

16. The combination according to claim 15, wherein said sleeves comprise rubber with a Shore-A hardness of about 60 and with a wall thickness in the range of 2 to 2.5 mm.

* * * * *